US007263744B2

(12) United States Patent
Kim et al.

(10) Patent No.: US 7,263,744 B2
(45) Date of Patent: Sep. 4, 2007

(54) HANDLE ASSEMBLY FOR REFRIGERATOR

(75) Inventors: Myoung-Kook Kim, Gyeongsangnam-do (KR); Sang-Ho Jung, Gimhae (KR)

(73) Assignee: LG Electronics Inc., Seoul (KR)

( * ) Notice: Subject to any disclaimer, the term of this patent is extended or adjusted under 35 U.S.C. 154(b) by 169 days.

(21) Appl. No.: 10/950,522

(22) Filed: Sep. 28, 2004

(65) Prior Publication Data

US 2005/0066479 A1 Mar. 31, 2005

(30) Foreign Application Priority Data

Sep. 29, 2003 (KR) ..... 10-2003-0067583
Oct. 21, 2003 (KR) ..... 10-2003-0073551

(51) Int. Cl.
*E05B 1/00* (2006.01)

(52) U.S. Cl. ..... 16/436; 16/412; 16/DIG. 40; 312/348.6; 49/461

(58) Field of Classification Search ..... 16/436, 16/440, 412, 413, 415, 416, 444, DIG. 40, 16/DIG. 41; 403/381, 387; 312/348.6, 401, 312/405, 244, 245, 247; 49/460, 461
See application file for complete search history.

(56) References Cited

U.S. PATENT DOCUMENTS 2,451,884 A * 10/1948 Stelzer ..... 248/251
2,731,662 A * 1/1956 Mills ..... 16/412
2,851,304 A * 9/1958 Timms ..... 239/56
2,961,694 A * 11/1960 May ..... 16/412
3,426,385 A * 2/1969 Gutshall ..... 16/412
3,995,349 A * 12/1976 Roberts et al. ..... 16/412
4,087,141 A * 5/1978 Roberts ..... 312/348.6
4,638,529 A * 1/1987 Katona ..... 16/436
5,144,718 A * 9/1992 Ozawa ..... 16/412
5,355,554 A * 10/1994 Magoon ..... 16/412
5,832,564 A * 11/1998 Shanok ..... 16/436
5,860,538 A * 1/1999 Duero et al. ..... 211/123

(Continued)

FOREIGN PATENT DOCUMENTS

DE 10259328 A1 * 7/2003

(Continued)

*Primary Examiner*—Chuck Y. Mah
(74) *Attorney, Agent, or Firm*—Birch, Stewart, Kolasch & Birch, LLP

(57) ABSTRACT

The present invention relates to a handle assembly for a refrigerator. According to the present invention, there is provided a handle assembly for a refrigerator. The handle assembly comprises a pair of handle holders each of which is formed with a cavity therein and mounted onto a front surface of a door by means of a screw that is fastened to the front surface of the door through the cavity; a handle body which is positioned between the handle holders and which is fastened to the handle holders by means of screws that penetrate the handle holders and are fastened thereto; and a handle cover elastically mounted to front ends of the handle holders and the handle body. According to the present invention, since the handle assembly can be mounted to the front surface of the door at the front of the door, the man-hour needed for the assembling works and the production costs can be reduced. Further, the external appearance of the handle assembly and the door can be made more elegant and the handle assembly can also be easily assembled to the door.

18 Claims, 7 Drawing Sheets

U.S. PATENT DOCUMENTS

| | | | | |
|---|---|---|---|---|
| 6,430,780 | B1 * | 8/2002 | Kim et al. | 16/412 |
| 6,959,480 | B2 * | 11/2005 | Wing et al. | 29/525.02 |
| 2003/0056334 | A1 * | 3/2003 | Finkelstein | 16/436 |
| 2004/0207304 | A1 * | 10/2004 | Cho | 312/405 |

FOREIGN PATENT DOCUMENTS

| | | | | |
|---|---|---|---|---|
| JP | SHO 56-99392 | | | 8/1981 |
| JP | 03158688 | A | * | 7/1991 |
| KR | 1020020029993 | A | | 4/2002 |

* cited by examiner

HANDLE ASSEMBLY FOR REFRIGERATOR

This Nonprovisional application claims priority under 35 U.S.C. § 119(a) on patent application No(s). 10-2003-0067583 and 10-2003-0073551 filed in Republic of Korea on Sep. 29, 2003 and Oct. 21, 2003, respectively, the entire contents of which are hereby incorporated by reference.

BACKGROUND OF THE INVENTION

1. Field of Invention

The present invention relates to a handle assembly for a refrigerator, and more particularly, to a handle assembly for a refrigerator which is gripped and operated by a user in order to open and close a door of the refrigerator.

2. Description of the Prior Art

A front surface of a door of a refrigerator is mounted with a handle assembly which is gripped by a user when the door is opened and closed. FIG. 1 is a transverse sectional view of a major portion of a handle assembly for a refrigerator according to a prior art. According to the figure, a front plate 2*a* and a door liner 2*b* define front and rear external appearances of a door 2, respectively. A fastening groove 2*c* is formed in the door liner 2*b* at a predetermined position. The fastening groove 2*c* concaves up to a position adjacent to a rear surface of the front plate 2*a*. The fastening groove 2*c* is a portion which is penetrated by a screw Sb for fastening a handle holder 4, which will be described bellow, to the door 2. A cap 2*d* is fitted into an inlet of the fastening groove 2*c* and then covers the interior of the fastening groove 2*c*. In addition, decoration caps 3 are installed on external appearances of portions of a front edge and side, upper, and lower surfaces of the door 2.

The front plate 2*a* of the door 2 is mounted with the handle holders 4. Each of the handle holders 4 is fastened to the door 2 by the screw Sb which penetrates the decoration cap 3 and the door liner 2*b* in the fastening groove 2*c*. The handle holders 4 are provided at upper and lower sides of a leading end or left and right sides of the front surface of the door 2.

Each of both ends of a handle 6 is fastened to the handle holder 4. The handle 6, which is shaped in an elongated bar, has a length as long as that between the handle holders 4. Each of the ends of the handle 6 is fastened to the handle holder 4 by a screw Sa which penetrates the handle holder 4 from its interior.

Upon review of an assembling process of the handle assembly according to the prior art, the handle holders 4 are first fastened to the handle 6 by using the screws Sa. In a state where the handle holders 4 are assembled to both the ends of the handle 6 as above, the handle holders 4 are fixed to the front surface of the door 2 by using the screws Sb.

Here, the screw Sb for fixing the handle holder 4 to the front surface of the door 2 fastens the handle holder 4 to the door 2 through the fastening groove 2*c* formed in the door liner 2*b* defining the rear surface of the door 2. Then, after the screw Sb fastens the handle holder 4 to the door 2 from the interior of the fastening groove 2*c*, the separate cap 2*d* of rubber is used in order to close the inlet of the fastening groove 2*c*.

However, the handle assembly for the refrigerator according to the prior art as described above has the following problems.

That is, in the prior art, since the separate fastening grooves 2*c* should be formed in the door liner 2*b*, the door liner 2*b* are further complicated. In addition, due to the existence of the fastening grooves 2*c*, there is a limitation on a thickness design of an insulating layer formed between the front plate 2*a* and the door liner 2*b*. That is, the reason is that when a depth of the fastening grooves 2*c* is above a certain value, the fastening grooves 2*c* cannot be formed through a vacuum forming process for the door liner 2*b*.

Further, the caps 2*d* made of the rubber should be additionally used to cover the fastening grooves 2*c*. Therefore, there is a problem in that the external appearance of the door liner 2*b* is relatively deteriorated.

In addition, the screw Sb for fastening the handle holder 4 to the door 2 should be fastened to the rear surface of the door 2. That is, it causes the problem that a process of fastening the screws Sb is relatively cumbersome because a worker are positioned opposite to the object to be fastened with respect to the door 2. Particularly, when the door 2 is heavy, its assembling workability is further reduced.

SUMMARY OF THE INVENTION

Accordingly, the present invention is conceived to solve the aforementioned problems in the prior art. An object of the present invention is to provide a handle assembly with simplified components and peripheral parts.

Another object of the present invention is to provide a handle assembly which makes an external appearance of a door elegant.

A further object of the present invention is to provide a handle assembly which makes its assembling process easy.

According to the present invention for achieving the objects, there is provided a handle assembly for a refrigerator, comprising a pair of handle holders each of which is formed with a cavity therein and mounted to a front surface of a door by means of a screw fastened to the front surface of the door through the cavity; a handle body positioned between the handle holders and fastened to the handle holders by means of screws, the screws penetrating the handle holders and being fastened thereto; and a handle cover elastically mounted to front ends of the handle holders and the handle body.

Preferably, the handle assembly as claimed in claim 1, wherein a rear end of each of the handle holders is formed with an insertion portion, the front surface of the door is formed with concave portions, the insertion portion is inserted into each of the concave portions, and the insertion portion and the concave portion are shaped not to rotate relatively with respect to each other.

Fastening projections for mounting the handle cover are formed on a front end of a fastening skirt in the front end of the handle holder, the fastening projections facing each other.

Further, a side of the handle holder is further provided with a spacer, the spacer being seated in the handle body and preventing the handle body from rotating.

Preferably, a front end of the handle body is formed with fastening projections, a rear end of the handle cover is formed with fastening grooves, the fastening projections are seated in the fastening grooves by elastically deforming the front end of the handle body, and thus, the handle cover is mounted to the handle body.

The handle holder is formed with a tool through-hole through which the cavity communicates with an outside, the tool through-hole is formed in a side wall opposite to a side wall in which a fastening hole for fastening the handle holder to the handle body is formed.

According to other aspect of the present invention, there is provided a handle assembly for a refrigerator, comprising a fixing holder formed with a fastening hole perforated forward and mounted to a front surface of a door; a handle holder formed with a fastening hole perforated forward and mounted to the front surface of the door while being spaced apart by a predetermined interval from the fixing holder; a handle with at least both ends formed with vent holes, the handle holder being press fitted into the vent hole of one end thereof; and a handle connector engaged to the other end of the handle and the fixing holder for engaging the handle with the fixing holder.

Preferably, catching pieces to be engaged with the handle connector are formed on both sides of a front end of the fixing holder to protrude, front ends of the catching pieces are formed with catching projections facing each other, and both sides of a rear end of a connector body of the handle connector are formed with elongated catching channels, the catching projections being press fitted and seated into the catching channels.

The handle connector is further provided with a flange which is in close contact with the catching piece and adjusts an extent of an insertion of the handle connector.

Further, a combined length of the fixing holder and the handle connector is formed to be the same as a length of the handle holder so that the handle is spaced apart by a constant interval from the front surface of the door.

The connection bosses, which are press fitted into the vent holes of both the ends of the handle, are formed on front end plates of the handle holder and handle connector, respectively; and front ends of the handle holder body and the handle connector body where the front end plates are formed are formed with seating surfaces into which outer surfaces of the both the ends of the handle are seated, the seating surfaces corresponding in shape to the outer surfaces.

The front end plate is shaped in a disk with a larger diameter than that of the handle.

According to the present invention so constructed, the man-hour needed for the assembling works can be reduced since the number of parts consisting of the handle assembly is minimized, causing the production costs to be reduced. Further, there are advantages in that the external appearance of the handle assembly and the door can be made elegant and in that it is easy to assemble the handle assembly to the door.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE PREFERRED EMBODIMENT

Hereinafter, preferred embodiments of a handle assembly for a refrigerator according to the present invention will be described in detail with reference to the accompanying drawings.

Figure 1:
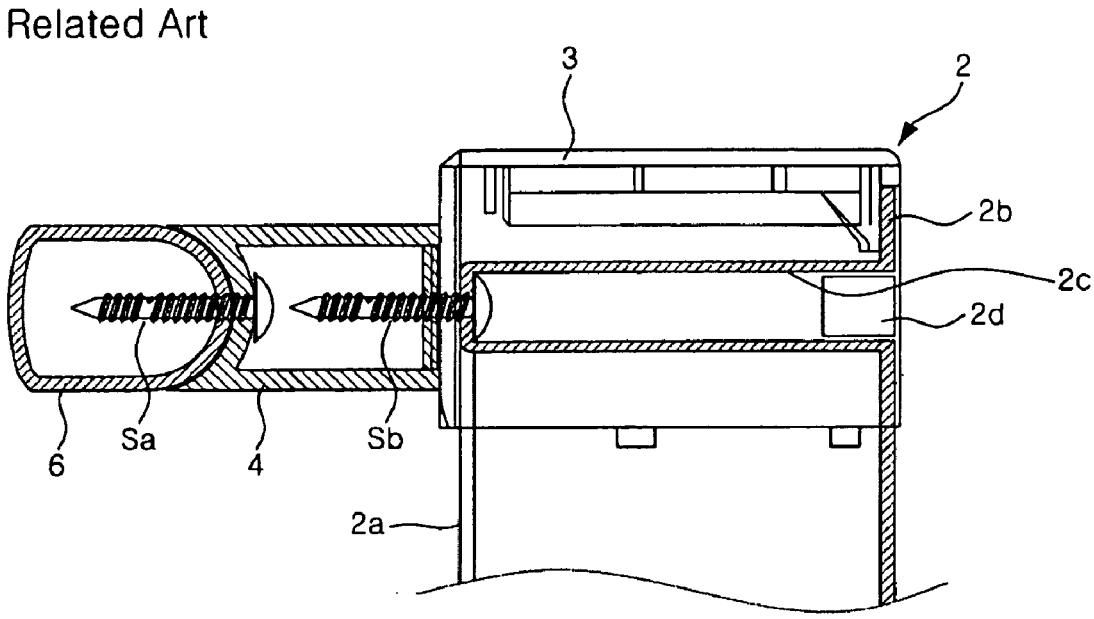
FIG. 1 is a sectional view of a major portion of a handle assembly according to a prior art.
Figure 2:
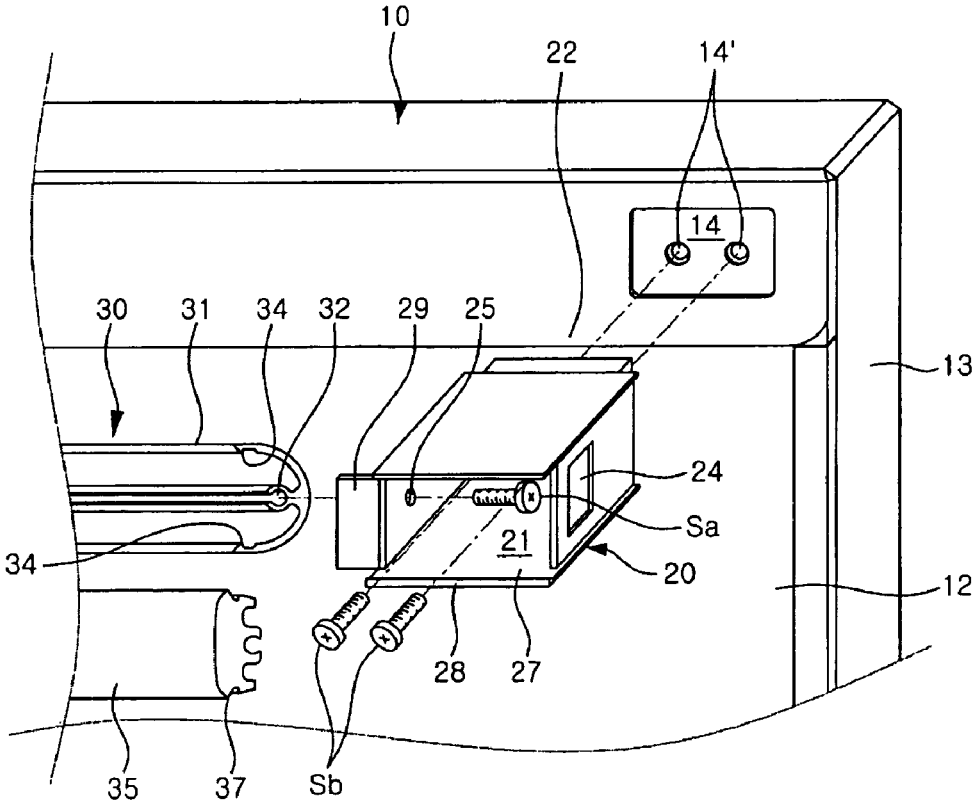
FIG. 2 is an exploded perspective view showing a first embodiment of a handle assembly for a refrigerator according to the present invention.
Figure 3:
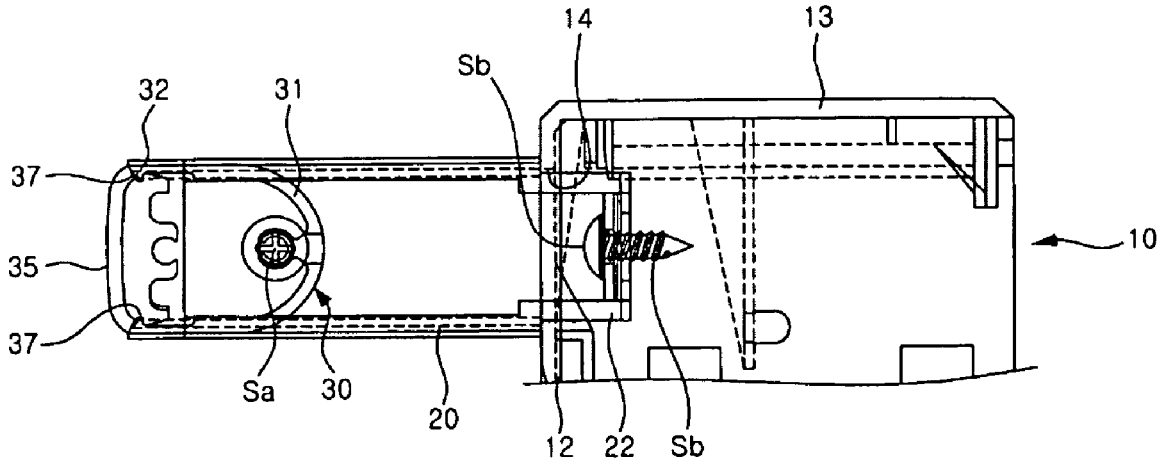
FIG. 3 is a sectional view showing a major portion of the first embodiment according to the present invention.

FIG. 2 is an exploded perspective view showing a first embodiment of the handle assembly for the refrigerator according to the present invention. FIG. 3 is a sectional view showing a major portion of the first embodiment according to the present invention.

Referring to the figures, a door 10 selectively opens and closes a storage space formed in a refrigerator main body. A front plate 12 defines a front surface of the door 10. In addition, decoration caps 13 are installed in order to define external appearances of a front edge and side and upper surfaces of the door 10.

The front surface of the door 10 is formed with concave portions 14. In the present embodiment, although the concave portions 14 are formed in the decoration cap 13, the concave portions 14 may be formed up to an insulating layer in the door 10 through the front plate 12 and the decoration caps 13. Positions where the concave portions 14 are formed are changed according to a structure for opening and closing the door 10. For example, if a side end of the door 10 is opened and closed around hinge assemblies at an opposite side end of the refrigerator main body, the concave portions 14 are formed at upper and lower ends of a leading end of the front surface of the door 10, wherein the leading end is a portion relatively far from the pivotal center of the door 10. In such a case, the handle assembly is installed in the vertical direction. In addition, as in the present embodiment, in the case that the door 10 is opened and closed in drawer-like fashion, the respective concave portions 14 are formed at both sides of the upper end of the front surface of the door 10. In such a case, the handle assembly is installed in the horizontal direction, as viewed from the front of the door 10.

Handle holders 20 are installed at the concave portions 14 formed in the front surface of the door 10, respectively. The handle holders 20 cause a handle 30, which will be described bellow, to be spaced apart by a constant interval from the front surface of the door 10 and to be supported. The handle holder 20 is formed by injection molding of synthetic resin and is shaped in a hollow hexahedron. That is, a cavity 21 is formed in the handle holders 20.

The handle holders 20 are fastened to the front surface of the door 10 by means of the screws Sb. From the cavity 21, the screw Sb penetrates a rear end of the handle holder 20 and is fastened into a fastening hole 14' of the concave portion 14. According to the above configuration of the present invention, it is noted that the fastening process of the screws Sb can be performed at the front surface of the door 10. The number of the screws Sb is determined according to conditions of length, weight or the like of the handle 30 which will be described bellow.

For reference, in order to securely fix the screw Sb, metal brackets (not shown) may be installed to the insulating layer of urethane foam formed in an interior of the door 10.

The handle holder 20 is formed with an insertion portion 22. The insertion portion 22, which is inserted into the concave portion 14, is relatively narrower than the other portions of the handle holder 20. In the present embodiment, the insertion portion 22 and the concave portion 14 are shaped in a hexahedron so that the handle holder 20 does not rotate with respect to the door 10.

A side wall of the handle holder 20 is formed with a tool through-hole 24 so that the cavity 21 of the handle holder 20 communicates with the outside. A fastening hole 25 is formed through a side wall opposite to the side wall of the handle holder 20 in which the tool through-hole 24 is formed. The fastening hole 25 is formed at a position corresponding to the near center of the tool through-hole 24. The fastening hole 25 is for fixing the handle 30 to the handle holder 20.

Fastening skirts 27, which are extended forward, are formed at upper and lower portions of a front end (with respect to FIG. 2) of the handle holder 20. The fastening skirts 27 are portions to which both ends of a handle cover 35, which will be described bellow, are engaged. A front end of each fastening skirt 27 is provided with a fastening projection 28.

A front end of the side wall of the handle holder 20, in which the fastening hole 25 is formed, is formed with a spacer 29. The spacer 29, which is formed in a plate shape, is positioned within a handle body 31, which will be described bellow, and thus, functions to securely engage the handle body 31 and the handle holder 20 to each other and to prevent the handle 30 from rotating inadvertently.

Both side ends of the handle 30 are fastened to the respective handle holders 20 by means of screws Sa. Both the side ends of the handle 30 are in close contact with the side walls of the handle holders 20 provided on the door 10, which are spaced apart by a predetermined distance from each other.

The handle 30 mainly consists of the handle body 31 and the handle cover 35. As shown in the figures, a cross section of the handle body 31 is shaped in an ellipse, and a front end thereof is opened along its whole length. Although the handle body 31 may be formed of metal or synthetic resin, it is most preferably formed by extrusion molding of aluminum.

A fastening portion 32 is provided within the handle body 31. In the case the handle body 31 is formed by the extrusion molding, the fastening portion 32 is formed over the whole of the handle body 31. The screws Sa are fastened at both the side ends of the fastening portion 32.

Upper and lower portions of the front end of the handle body 31, i.e., portions of the handle body 31 facing the same direction as the front of the door 10, are formed with fastening projections 34, respectively. Distal ends of the fastening projections 34 are formed to face each other. The respective fastening projections 34 are formed along the whole length of the handle body 31. The front end of the handle body 31, in which the fastening projections 34 are formed, is flat formed corresponding to the fastening skirts 27. The cross sections of the front end of the handle body 31 and the fastening skirt 27 can be fully shown in FIG. 3.

The handle cover 35, of which both sides of a rear end are formed with fastening grooves 37, is mounted on the front end of the handle body 31. The respective fastening grooves 37 are formed along a whole length of the handle cover 35. The fastening projections 34 of the handle body 31 and the fastening projections 28 of the handle holders 20 are seated into the fastening grooves 37 by elastic deformation.

The handle cover 35, which defines a front external appearance of the handle 30, may be formed of metal or synthetic resin. It is preferred that the handle cover 35 be formed by extrusion molding of aluminum. The cross section of the handle cover 35 is fully shown in FIG. 3.

Figure 4:
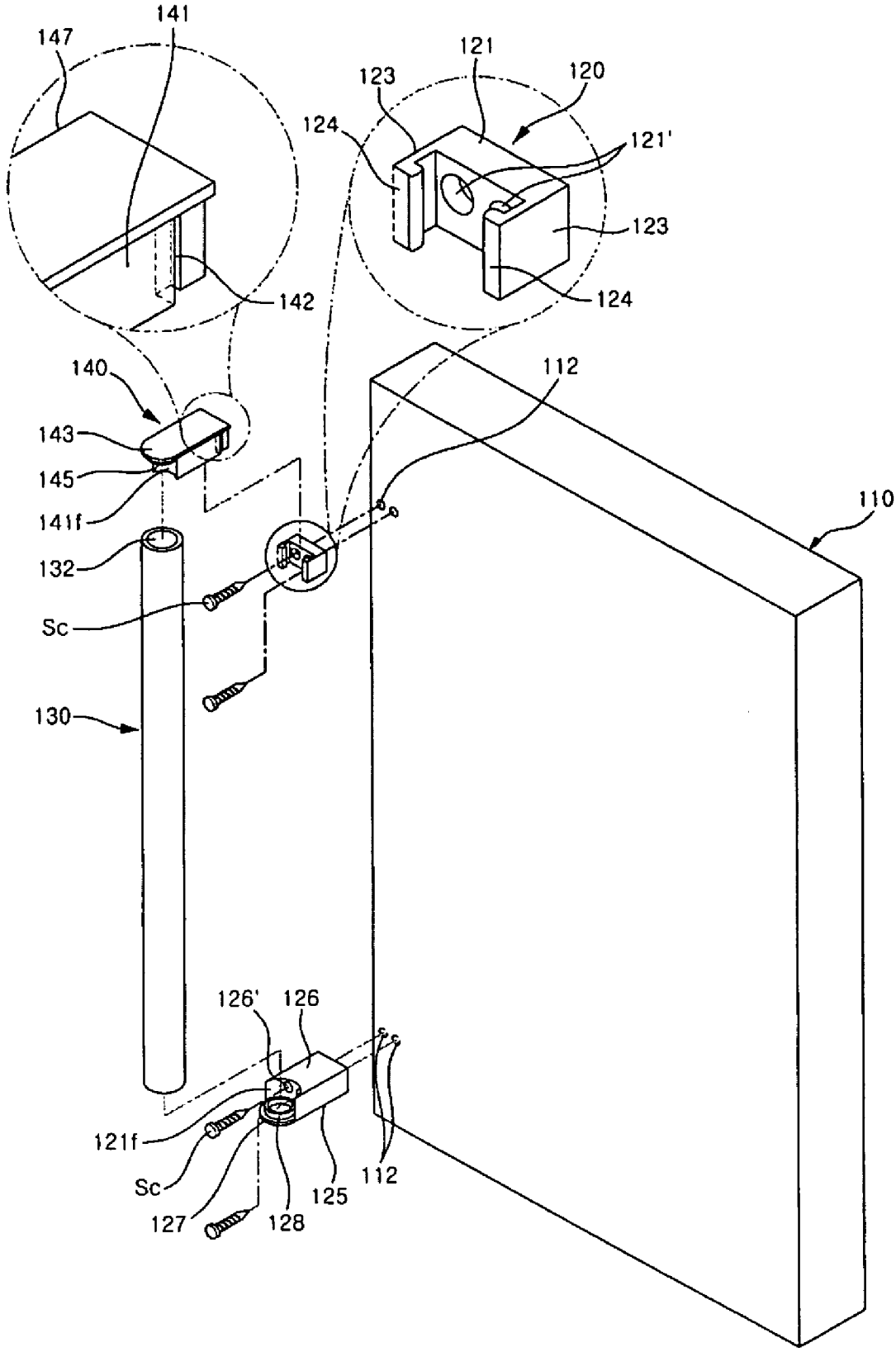
FIG. 4 is an exploded perspective view showing a second embodiment according to the present invention.
Figure 5:
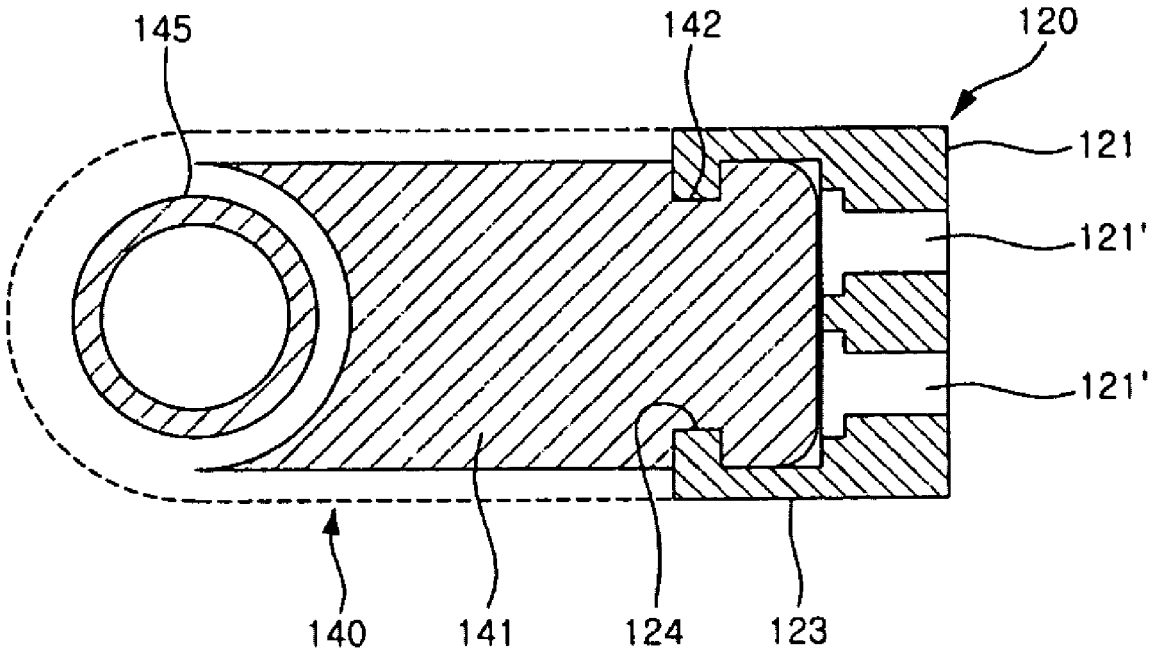
FIG. 5 is a cross-sectional view of a major portion of the second embodiment according to the present invention.

In the meantime, FIG. 4 is an exploded perspective view of a second embodiment according to the present invention. FIG. 5 is a transverse sectional view showing a major portion of the second embodiment according to the present invention.

As shown in the figures, a pair of fastening holes 112 are perforated at each of upper and lower ends of a side of a front surface of a door 110 for the refrigerator which is pivotably installed at a side of the refrigerator main body corresponding to the other opposite side of the door. For reference, although in the present embodiment, the respective two pairs of the fastening holes 112 are perforated at the upper and lower ends of the side of the door 110 at a predetermined vertical interval, the two pairs of the fastening holes 112 may be perforated at both the sides of the door 110 at a predetermined lateral interval according to an opening and closing fashion of the door 110.

The fastening holes 112 which are provided at the relatively upper end out of the two pairs thereof are mounted with a fixing holder 120. A fixing holder body 121 of the fixing holder 120 is shaped substantially in a hexahedron. At least one fastening hole 121' is perforated forward through the fixing holder body 121. Although in the present embodiment, two of the fastening holes 121' are perforated, only one fastening hole 121' may be formed.

Then, in order to securely mount the fixing holder 120 to the door 110, as in the first embodiment, a front surface of the door 110 in which the fastening holes 112 are formed may be relatively concaved, and a rear end of the fixing holder body 121 corresponding thereto may be formed to protrude in the shape corresponding to the concave portion formed in the front surface of the door 110. It is preferred that the concave portion of the door 110 and the protruding portion of the fixing holder body 121 be formed in shapes not to rotate with respect to each other.

Catching pieces 123 are provided at both sides of a front end of the fixing holder body 121 to face each other. Each of the catching pieces 123, which is shaped into a quadrangular plate, is extended to the front of the fixing holder body 121 by a predetermined length. Catching projections 124 are formed on distal ends of the catching pieces 123 to face each other. The respective catching projections 124 are formed on the distal ends of the catching pieces 123 and vertically elongated.

The fastening holes 112 which are provided at the relatively lower end out of the two pairs thereof are mounted with a handle holder 125. A handle holder body 126 of the handle holder 125 is shaped substantially in an elongated hexahedron. At least one fastening hole 126' is perforated forward through the handle holder body 126. For reference, in order to securely fix the handle holder 125 to the door 110, as described in relation to the fixing holder 120, a rear surface of the handle holder body 126 and a corresponding portion of the door 110 may be provided with uneven shaped portions corresponding to each other.

A front end of the handle holder body 126 is formed with a seating surface **121*f* corresponding in shape to an outer surface of a handle 130, which will be described below. A portion of the outer surface of the handle 130 is seated onto the seating surface 121*f*. A front end plate 127 is provided to extend forward from a lower portion of the front end of the handle holder body 126 in which the seating surface 121*f* is formed. The front end plate 127 is formed in a circular disk shape with the same diameter as a diameter of at least the handle 130. A connection boss 128 to be press fitted into a vent hole 132 of the handle 130 is formed on the front end plate 127** to protrude upward.

The handle 130 has a length as long as an interval between the two pairs of the fastening holes 112. The handle 130 is a portion which a user grips and applies a force to in order to open and close the door 110. The handle 130 is manufactured of metal or synthetic resin. For example, it is preferred that the handle 130 be manufactured by extrusion molding of aluminum.

The handle 130 is preferably formed in a pipe shape. Otherwise, if the handle 130 is not hollow, the vent holes 132 should be formed in at least both ends of the handle 130. The vent holes 132 have diameter to the extent that the connection boss 128 of the handle holder 125 and a connection boss 145 of a handle connector 140, which will be described bellow, are press fitted into the vent holes 132, respectively.

The handle connector 140 connects the fixing holder 120 and an end of the handle 130 to each other. A connector body 141 of the handle connector 140 is also shaped substantially in an elongated hexahedron. A combined length of the handle connector 140 and the fixing holder 120 should be the same as a length of the handle holder 125. It is for the purpose of generally spacing the handle 130 apart by a constant distance from the front surface of the door 110.

A front end of the connector body 141 is formed with a seating surface 141*f* corresponding in shape to the outer surface of the handle 130. An opposite portion of the outer surface of the handle 130 is seated onto the seating surface 141*f*.

Elongated catching channels 142 are vertically formed in both side surfaces of a rear end of the connector body 141, respectively. The catching channels 142 are portions into which the catching projections 124 of the fixing holder 120 are seated. Therefore, a distance from the rear end of the connector body 141 to the catching channels 142 should be the same as a distance from a proximal portion of the catching pieces 123 to the catching projections 124. The connector body 141 and the catching pieces 123 are sized so that the connector body 141 is press fitted between the catching pieces 123.

A front end plate 143 is extended forward from an upper portion of the front end of the connector body 141. The front end plate 143 is shaped in a circular disk with the same diameter as a diameter of at least the handle 130. The connection boss 145 to be press fitted into the vent hole 132 of the handle 130 is formed on the front end plate 143 to protrude downward.

In the meantime, a flange 147 is formed on an upper surface of the connector body 141. The flange 147 protrudes more than both side surfaces of the connector body 141. The flange 147 is formed in at least the rear end of the connector body 141. The flange 147 is in contact with an upper end of the catching pieces 123 of the fixing holder 120, and thus, determines a position where the handle connector 140 is inserted into the fixing holder 120. Therefore, the flange 147 may be formed only in a position corresponding to the catching pieces 123.

Hereinafter, the operation of the handle assembly according to the present invention so constructed will be described in detail.

First, an assembling process of the handle assembly of the first embodiment shown in FIGS. 2 and 3 will be described. The insertion portion 22 of the handle holder 20 is seated into the concave portion 14 of the door 10. Through the cavity 21 of the handle holder 20, the screws Sb penetrate the handle holder 20 and are fastened into the fastening holes 14' of the concave portion 14. After two of the handle holders 20 are fastened onto the door 10 in the same manner, the handle body 31 is fastened to the handle holders 20.

That is, the handle body 31 is inserted between both the handle holders 20. At this time, the spacers 29 are seated within both side ends of the handle body 31, and both the side ends of the handle body 31 are in close contact with the side walls of the handle holders 20, respectively. In such a state, the screws Sa penetrate the fastening holes 25 and then are fastened into the fastening portions 32 of the handle body 31. A tool for fastening the screw Sa is introduced into the cavity 21 through the tool through-hole 24.

The handle cover 35 is mounted to the handle body 31 both the side ends of which are fixed to the handle holders 20. While the fastening projections 34, which are formed at the upper and lower portions of the front end of the handle body 31 in the lengthwise direction, are elastically deformed and then restored to its original form, the fastening projections 34 are securely seated in the fastening grooves 37, respectively, so that the handle cover 35 is mounted to the handle body 31. Accordingly, both the ends of the handle cover 35 are engaged to the handle holders 20. That is, the fastening projections 28 formed in the fastening skirts 27 are seated in the fastening grooves 37 of the handle cover 35, respectively, so that the handle cover 35 is engaged to the handle holders 20.

For reference, when the handle assembly of the present embodiment is horizontally installed, it is preferred that separate caps be installed so that the side walls of the handle holders 20, i.e., portions where the tool through-holes 24 are formed do not appear. It is also preferred that the caps be configured so that the whole side walls of the handle holders 20 and even both the sides of the handle cover 35 are covered with the caps.

Next, an assembling process of the second embodiment of the present invention will be described with reference to FIG. 6.

Figure 6A:
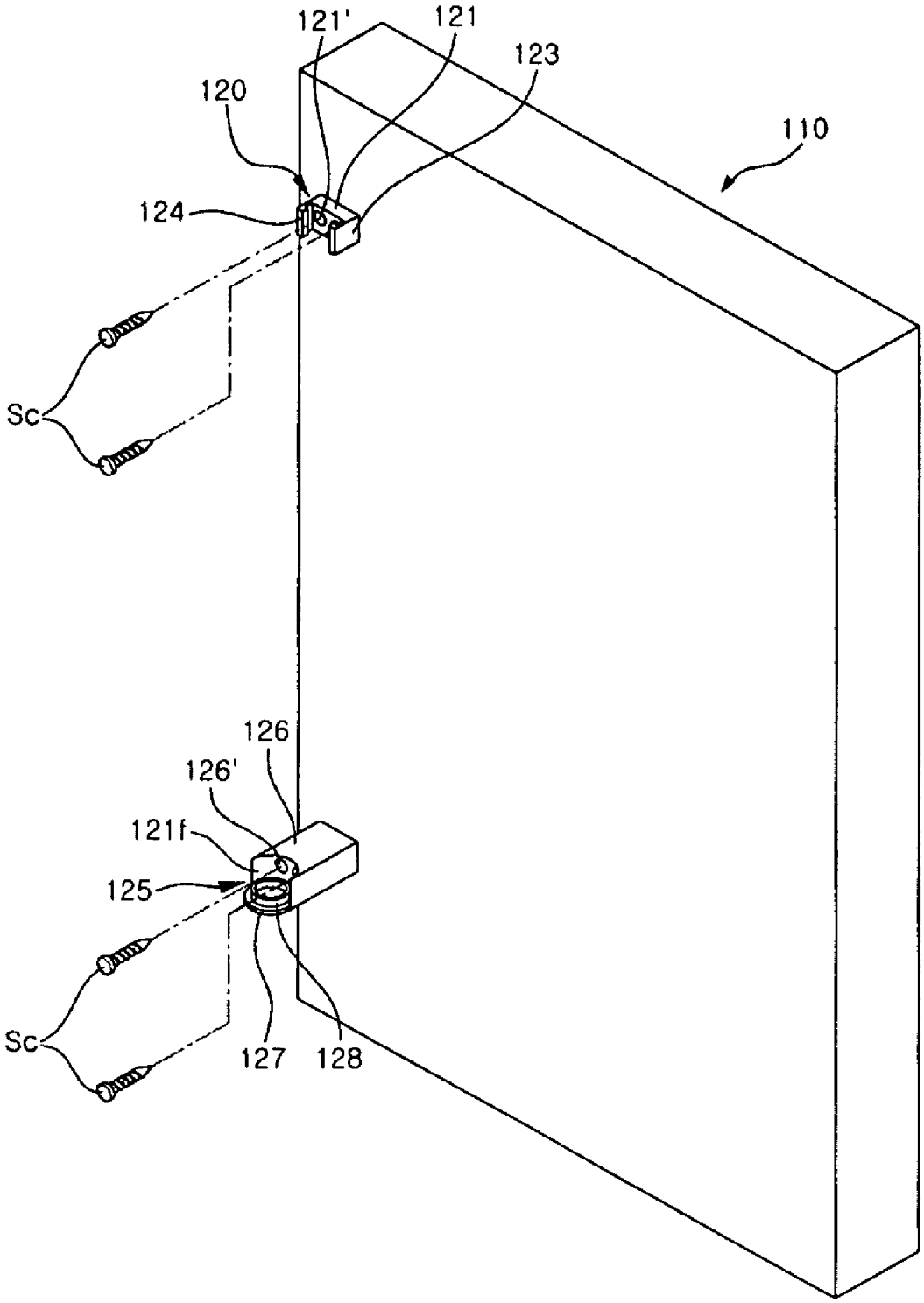
FIGS. 6*a* and 6*c* are views sequentially showing the processes of assembling the handle assembly according to the second embodiment of the present invention.

First, at the front of the door, the fixing holder 120 and the handle holder 125 are mounted on the front surface of the door 110. That is, screws Sc penetrate the fastening holes 121' of the fixing holder body 121 and the fastening holes 126' of the handle holder body 126 and then are fastened into the fastening holes 112 of the front surface of the door 110, respectively. Such a state is shown in FIG. 6*a*.

Figure 6B:
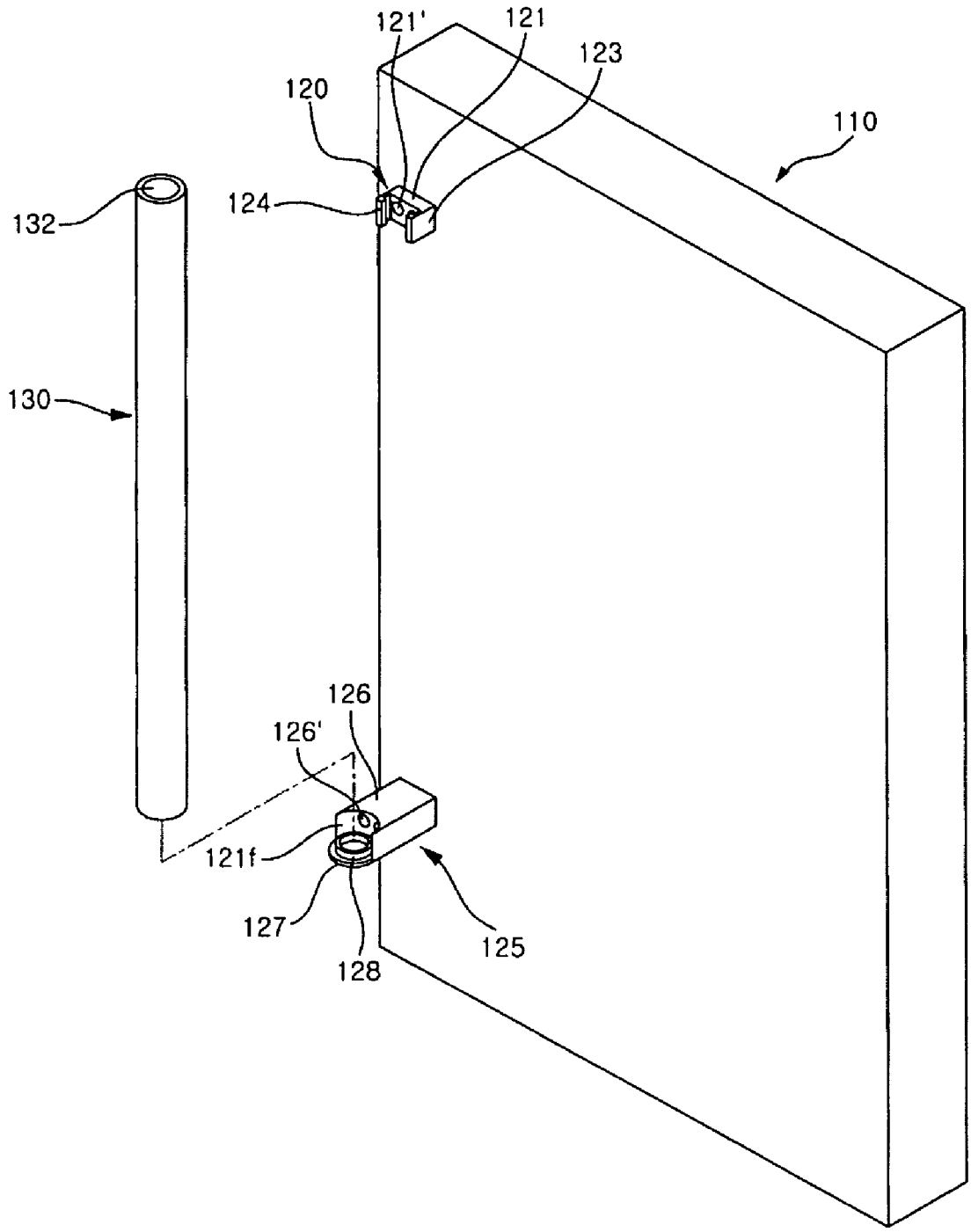

Next, as shown in FIG. 6*b*, the handle 130 is engaged to the handle holder 125. That is, the connection boss 128 of the handle holder body 126 is press fitted into the vent hole 132 opened to the lower end of the handle 130. At this time, the portion of the outer surface of the handle 130 is in contact with the seating surface 121*f* of the handle holder body 126.

Figure 6C:
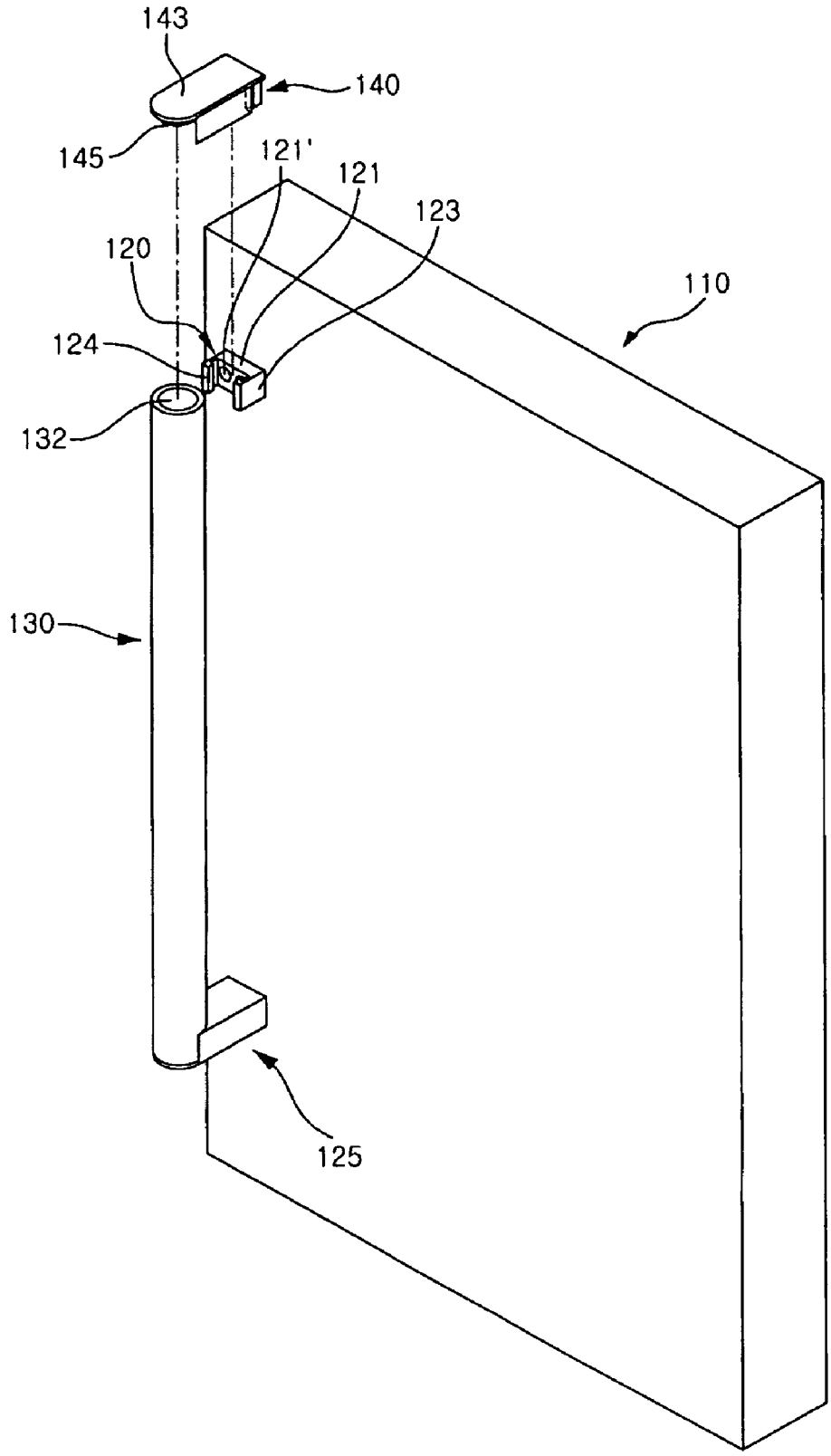

After engaging the lower end of the handle 130 to the handle holder 125, as shown in FIG. 6*c*, the upper end of the handle 130 is connected to the fixing holder 120 by means of the handle connector 140. That is, the catching channels 142 of the handle connector 140 are placed at positions corresponding to the catching projections 124 of the fixing holder 120, and the connection boss 145 of the handle connector 140 is placed at a position corresponding to the vent hole 132 of the handle 130.

Then, as shown in FIG. 6*c*, by moving the handle connector 140 downward, the catching projections 124 and the connection boss 145 are press fitted into the catching channels 142 and the upper end of the handle 130, respectively. Here, the extent of the insertion of the handle connector 140 is determined by the front end plate 143 and the flange 147. That is, if a lower surface of the front end plate 143 is in close contact with the upper end of the handle 130 and the flange 147 is in contact with the upper end of the catching pieces 123, the handle connector 140 no more moves downward. Accordingly, the portion of the outer surface of the handle 130 is seated onto the seating surface 141*f* of the connector body 141.

According to the handle assembly for the refrigerator of the present invention so constructed, the following advantages can be expected.

First, since the components for mounting the handle assembly are provided only in the front surface of the door, the structure of the rear surface of the door can be simplified. Thus, the rear surface of the door is in close contact with a front surface of the refrigerator main body, so that cooling air can be effectively prevented from leaking out.

In addition, in the present invention, since the constructions provided in the door for installing the handle assembly are covered with the handle holder or fixing holder and thus do not appear from the outside, it is possible to make the external appearance of the door elegant.

Furthermore, in the present invention, since the mounting process of the handle assembly is performed entirely in front of the door, the mounting process of the handle assembly can be more easily performed, improving efficiency for assembling the refrigerator.

Particularly, in the second embodiment of the present invention, since a screw may not be used for installing the handle to the handle holder or the fixing holder, an additional part for covering the screw is not necessary. Thus, there are advantages in that the fastening process can be easily performed and the production costs of the refrigerator door are reduced.

The scope of the present invention is not limited to the embodiments described and illustrated above but is defined by the appended claims. It will be apparent that those skilled in the art can make various modifications and changes thereto within the scope of fundamental technical spirit of the present invention. Therefore, the true scope of the present invention should be defined on the basis of the appended claims.

For example, although in the second embodiment, the handle 130 is shaped in a pipe and the connection bosses 128 and 145 are shaped to correspond to both the ends of the handle 130, the handle 130 may be shaped into a pillar having a polygonal sectional area and the connection bosses 128 and 145 are shaped to correspond to the handle 130.

What is claimed is:

1. A handle assembly for a refrigerator, comprising:

a pair of handle holders, each of which is formed with a cavity therein and mountable to a front surface of a door by a fastener inserted through the cavity in a first direction;

a handle body positioned between the handle holders and fastened to the handle holders by fasteners, the fasteners penetrating the handle holders orthogonal to the first direction and being fastened thereto; and a handle cover elastically mounted to front ends of the handle holders and the handle body.

2. The handle assembly as claimed in claim 1, wherein a rear end of each of the handle holders is formed with an insertion portion, each of the insertion portions is insertable into concave portions on the front surface of the door.

3. The handle assembly as claimed in claim 2, wherein fastening projections for mounting the handle cover are formed on a front end of a fastening skirt in the front end of each handle holder, the fastening projections facing each other.

4. The handle assembly as claimed in claim 1, wherein a side of each handle holder is further provided with a spacer, the spacer being seated in the handle body and preventing the handle body from rotating.

5. The handle assembly as claimed in claim 1, wherein a front end of the handle body is formed with fastening protections, a rear end of the handle cover is formed with fastening grooves, the fastening projections are seated in the fastening grooves by elastically deforming the front end of the handle body, thereby the handle cover is mounted to the handle body.

6. The handle assembly as claimed in claim 1, wherein each handle holder is formed with a tool through-hole through which the cavity communicates with an outside, the tool through-hole is formed in a side wall opposite to a side wall in which a fastening hole for fastening the handle holder to the handle body is formed.

7. The handle assembly as claimed in claim 1, further comprising caps for covering both ends of the handle cover and the handle holder.

8. The handle assembly as claimed in claim 1, wherein the fasteners are screws.

9. The handle assembly as claimed in claim 1, wherein the fasteners penetrating the handle holders penetrate through the cavities.

10. A handle assembly for a refrigerator, comprising:

a fixing holder formed with a fastening hole perforated forward and mountable to a front surface of a door;

a handle holder formed with a fastening hole perforated forward and mountable to the front surface of the door while being spaced apart by a predetermined interval from the fixing holder;

a handle with at least both ends formed with vent holes, the handle holder being fitted into the vent hole of one end thereof and the handle being orthogonal to the fastening holes of the fixing holder and handle holder; and a handle connector engaged to the other end of the handle and the fixing holder for engaging the handle with the fixing holder.

11. A handle assembly for a refrigerator, comprising:

a fixing holder formed with a fastening hole per perforated forward and mountable to a front surface of a door;

a handle holder formed with a fastening hole perforated forward and mountable to the front surface of the door while being spaced apart by a predetermined interval from the fixing holder;

a handle with at least both ends formed with vent holes, the handle holder being fitted into the vent hole of one end thereof; and a handle connector engaged to the other end of the handle and the fixing holder for engaging the handle with the fixing holder, wherein catching pieces to be engaged with the handle connector are formed on both sides of a front end of the fixing holder to protrude, front ends of the catching pieces are formed with catching projections facing each other, and both sides of a rear end of a connector body of the handle connector are formed with elongated catching channels, the catching projections being press fitted and seated into the catching channels.

12. The handle assembly as claimed in claim 11, wherein the handle connector is further provided with a flange which is in close contact with the catching piece and adjusts an extent of an insertion of the handle connector.

13. The handle assembly as claimed in claim 11 wherein a combined length of the fixing holder and the handle connector is formed to be the same as a length of the handle holder.

14. The handle assembly as claimed in claim 10, wherein connection bosses, which are fitted into the vent holes of both the ends of the handle, are formed on front end plates of the handle holder and handle connector, respectively; and front ends of the handle holder body and the handle connector body where the front end plates are formed with seating surfaces into which outer surfaces of the both the ends of the handle are seated, the seating surfaces corresponding in shape to the outer surfaces.

15. The handle assembly as claimed in claim 14, wherein each front end plate is shaped in a disk with a larger diameter than that of the handle.

16. A handle assembly for a refrigerator, comprising:

a fixing holder formed with a fastening hole perforated forward and mountable to a front surface of a door;

a handle holder formed with a fastening hole perforated forward and mountable to the front surface of the door while being spaced apart by a predetermined interval from the fixing holder;

a handle with at least both ends formed with vent holes, the handle holder being fitted into the vent hole of one end thereof, the handle covering the fastening hole of the handle holder; and a handle connector engaged to the other end of the handle and the fixing holder for engaging the handle with the fixing holder, wherein the handle connector covers the fastening hole of the fixing holder.

17. A refrigerator door assembly, comprising:

a door having a front surface, the front surface of the door having concave portions; and a handle assembly mounted to the front surface of the refrigerator door, the handle assembly including:

a pair of handle holders, each handle holder being formed with a cavity therein and an insertion portion on a rear end thereof, each handle holder being mounted to the front surface of the door by a fastener fastened to the front surface of the door through the cavity and each insertion portion being inserted into one of the concave portions such that each handle portion does not rotate relative to the door;

a handle body positioned between the handle holders and fastened to the handle holders by fasteners, the fasteners penetrating the handle holders and being fastened thereto; and a handle cover elastically mounted to front ends of the handle holders and the handle body.

18. A refrigerator door assembly, comprising:

a door having a front surface; and a handle assembly mounted to the front surface of the door, the handle assembly including:

a fixing holder formed with a fastening hole perforated forward and mounted to the front surface of the door;

a fixing holder fastener extending through the fastening hole and penetrating the front surface of the door;

a handle holder formed with a fastening hole perforated forward and mounted to the same front surface as the fixing holder while being spaced apart by a predetermined interval from the fixing holder;

a handle holder fastener extending through the fastening hole and penetrating the front surface of the door;

a handle with at least both ends formed with vent holes, the handle holder being fitted into the vent hole of one end thereof; and a handle connector engaged to the other end of the handle and the fixing holder fur engaging the handle with the fixing holder.

* * * * *